United States Patent [19]

Clemens et al.

[11] Patent Number: 4,839,999

[45] Date of Patent: Jun. 20, 1989

[54] WALL STUD ASSEMBLY WITH FLANGE RETAINING SECTIONS

[75] Inventors: Forrest E. Clemens, Sherman Oaks; Jack Doke, Walnut, both of Calif.

[73] Assignee: Clemco Roll Forming, Inc., City of Industry, Calif.

[21] Appl. No.: 134,687

[22] Filed: Dec. 18, 1987

[51] Int. Cl.[4] ..... E04C 3/32

[52] U.S. Cl. ..... 52/36; 52/732

[58] Field of Search ..... 52/36, 732

[56] References Cited

U.S. PATENT DOCUMENTS 3,668,827 6/1972 Schwartz ..... 52/36

4,581,859 4/1986 Doke et al. ..... 52/36

*Primary Examiner*—James L. Ridgill, Jr.

*Attorney, Agent, or Firm*—Elliott N. Kramsky

[57] ABSTRACT

A stud assembly, for use in framing a wall unit, that generally includes a stud and a bracket support. The stud includes a pair of unitary elongated channels arranged back-to-back from a common flat web. Each one of the channels is a mirror image of the other channel. The web extends integrally into, and interconnects two generally similarly elongated shoulder portions. Each one of the shoulder portions defines a stepped section for receiving and retaining a bracket support. Each of the stepped sections extends integrally into, and interconnects two generally similar flange retaining sections, for rigidifying the shoulder portion, and for securing the bracket support into frictional engagement with the stud.

2 Claims, 2 Drawing Sheets

FIG. 2
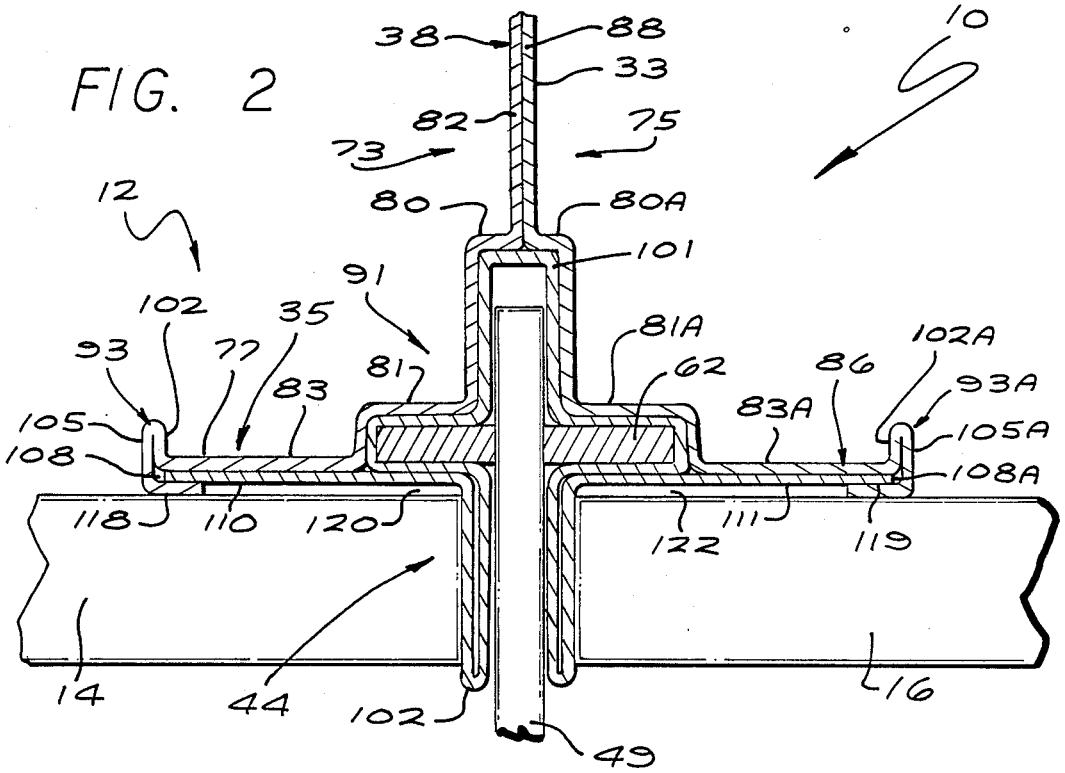
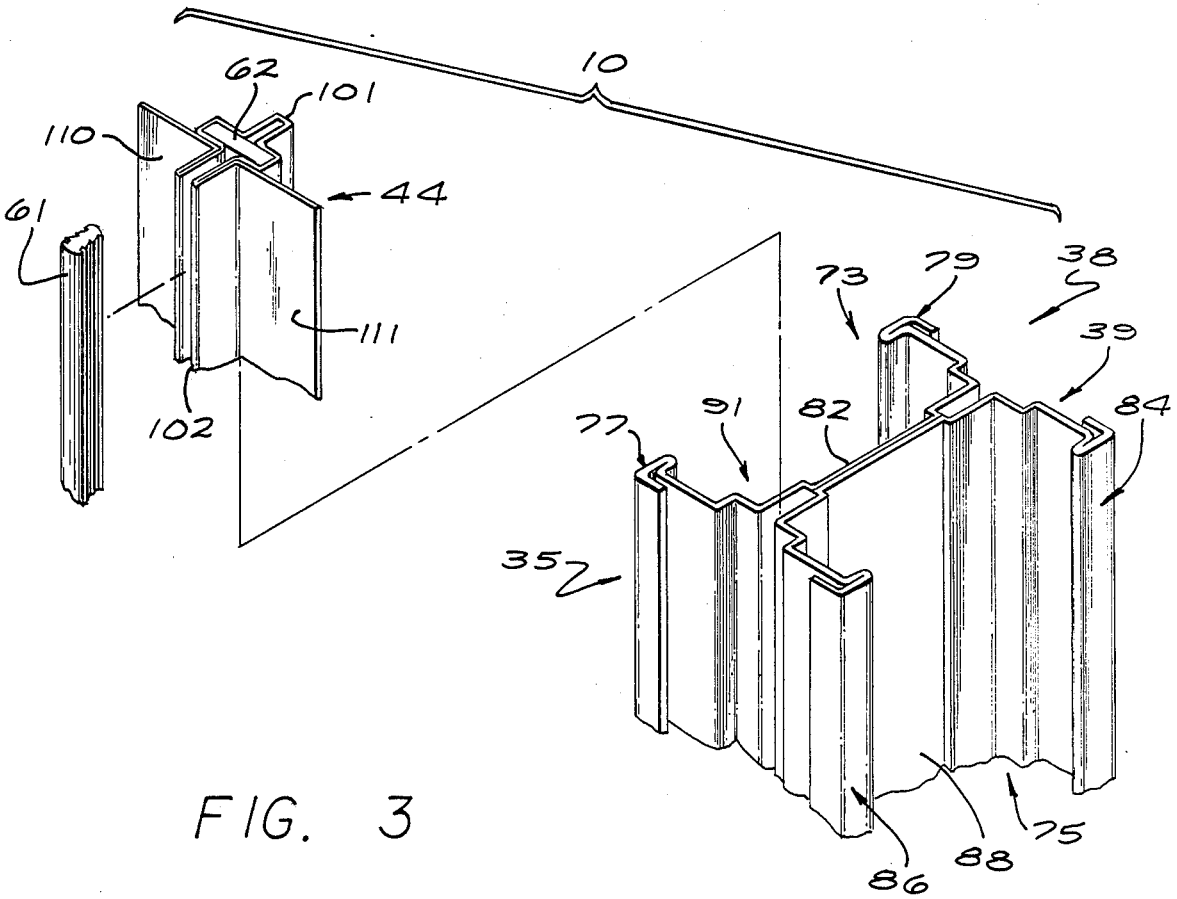
FIG. 3

WALL STUD ASSEMBLY WITH FLANGE RETAINING SECTIONS

BACKGROUND

1. Field of the Invention

The present invention relates in general to wall structures, and it more particularly relates to a new and improved wall stud assembly adaptable for use in wall units, such as the type that include panels of drywall material supported by a framed structure.

2. Description of the Prior Art

Wall structures such as partition walls of the type found in offices, libraries, as well as factories and merchandising establishments have become increasingly critical and essential in modern construction. Partition walls are widely used to provide an aesthetic decorative design to the space being partitioned, and further to enable the user to place items on open shelves for display or ready accessibility. Additionally, such partition walls can be employed to define a semi-permanent arrangement of office or other space, suitable to the retail or other business tenant's needs.

For this and other purposes, the conventional wall structures have generally included a series of vertically arranged, spaced-apart wall studs for interconnecting the wallboard panels, and for engaging one or more bracket support structures. The bracket support structures, in turn, retain a plurality of shelf brackets, that are generally used to support several shelves, and generally include perforated wall standards for accomodating the inner tongues of the shelf brackets.

Representative wall unit arrangements of this type are disclosed in the following U.S. Pat. Nos.: 3,394,507 of Doke for "Metallic Structure for Interior Walls to Carry Shelf Brackets and Wallboard"; 3,407,547 of Doke et al. for "Metallic Wall Stud Structure for Supporting Shelf Brackets"; 3,492,766 of Andrews for "Adjustable Stud"; 3,509,669 of Plemens for "Support Structure for Shelving"; 3,714,748 of Costruba for "Support Structure for Shelving"; 3,730,477 of Wavrunek for "Bracket Support Unit for Integral Wall Construction"; 4,581,859 of Doke et al. for "Wall Stud for Simplified Assembly"; and 4,588,156 Doke et al, for "Integral Bracket Support Structure".

While the wall stud and bracket support arrangements described in the latter two patents have addressed and resolved numerous problems in the relevant field, and have presented noticeable improvements over the prior known structures, there still remains a particular need for an improved wall stud assembly which is advantageously configured to satisfy the requirements and expectations of modern construction techniques and financial objectives. In this regard, one of the main concerns of the modern construction industry is the increasing cost of skilled labor, materials, production, storage, transportation, assembly, installation and maintenance. The aforelisted conventional arrangements are not adapted to be assembled by the manufacturer prior to shipment to the construction site. Thus the increased volume of the separate parts results in increased transportation and logistics costs.

Assembling such numerous parts on the construction site entails additional concerns. The installer must assemble a cumbersome unit frame, including a pair of studs, bracket support structures, wall standards, shelf brackets and associated materials, and furthermore, he or she must then struggle with a somewhat disassembled unit. Alternatively, the assembler is forced to seek the assistance of additional labor at the expense of an increased labor cost. Regardless of the selected solution, the installation of the wall unit is not easily, readily nor conveniently achieved.

The above installation problems are compounded further by the numerous, and almost inevitable, mishaps on the construction site. One such frequently encountered mishap is the damage caused by an accidental forklift impact on the wall structure. Whereupon, the components of the wall stud structure tend to dissociate, thus forcing the installer to endure again the undue inconvenience of re-assembling the parts. Moreover, the heavy metallic structure of the wall frame, and the awkward installation problems associated therewith, render the task of aligning the frame properly and accurately, a very difficult objective to attain..

Therefore, it would be highly desirable to have a new and improved stud assembly which is compatible with the needs of contemporary construction and wall unit designs. The stud assembly should offer economy, ease and convenience of manufacture, assembly, packaging, storage, transportation, installation and maintenance. The stud assembly should further have a sturdy construction, and it should allow for deformation in the frame structure, resulting from variances in the ambient temperature.

SUMMARY OF THE INVENTION

Therefore, an object of the present invention is to provide a new and improved wall stud assembly, which is configured for rapid. facile and economical wall frame assembly.

A further object of the present invention is to provide a new and improved wall stud assembly, which is sturdy in construction.

Briefly, the above and further objects of the present invention, are realized by providing a new and improved wall stud assembly for use in framing a wall unit. The stud assembly generally includes a stud and a bracket support, and a pair of unitary elongated channels, arranged back-to-back to form a common flat web. Each one of the channels is a mirror image of the other channel. The web extends integrally into, and interconnects two generally similarly elongated shoulder portions.

Each one of the shoulder portions defines a stepped section for receiving and retaining a bracket support. The stepped section extends integrally into, and interconnects two generally similar flange retaining sections, for rigidifying the shoulder portion, and for further securing the bracket support into frictional engagement with the stud.

BRIEF DESCRIPTION OF THE DRAWINGS

The above-mentioned and other objects and features of this invention, and the manner of attaining them, will become apparent, and the invention itself will be best understood by reference to the following description of the embodiment of the invention taken in conjunction with the accompanying drawings, wherein:

FIG. 2 is an enlarged fragmentary, sectional view of the stud assembly of FIG. 1, taken substantially on line 2—2 thereof; and FIG. 3 is an enlarged, exploded, pictorial, fragmentary view of the stud assembly of FIG. 1.

DETAILED DESCRIPTION

Figure 1:
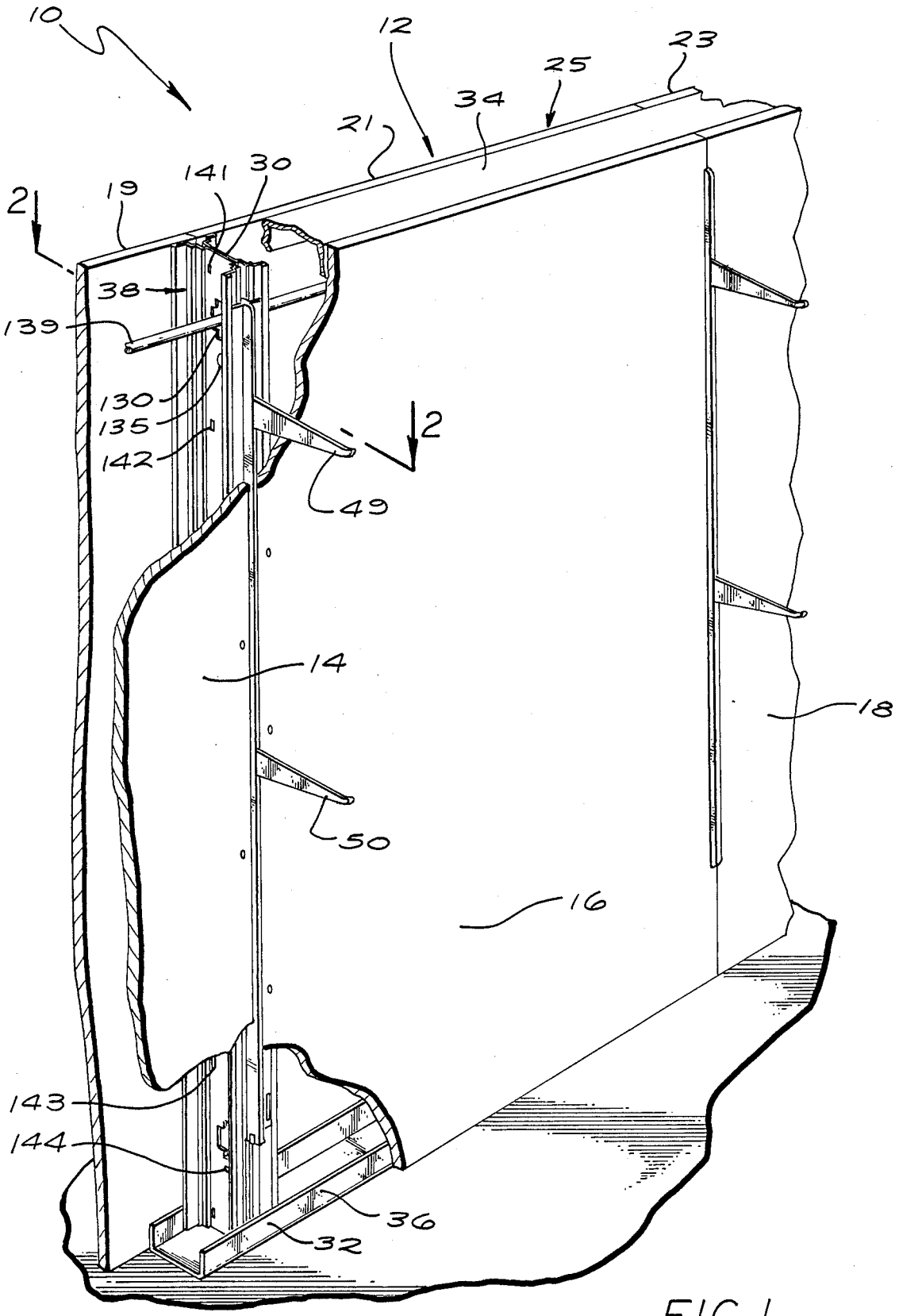
FIG. 1 is a pictorial, partially broken away, fragmentary view of a wall stud assembly constructed in accordance with the present invention, and shown incorporated in a wall unit.

Referring now to the drawings, there is illustrated a stud assembly 10 that is constructed in accordance with the present invention, and that is adopted for use in a wall unit 12. The wall unit 12 includes a frame structure 25, which is enclosed by, and secured to, a series of upright adjacent wallboard surface panels, such as the panels 14, 16 and 18, counted on one side of the frame structure 25. Another series of upright adjacent wallboard surface panels, such as the panels 19, 21 and 23 are mounted on the other side of the frame structure 25, in generally parallel registration relative to the panels 14, 16 and 18 respectively.

The frame structure 25 includes a plurality of elongated upright spaced-apart generally similar stud assemblies, such as the stud assembly 10, which are interconnected at their respective upper and lower ends by a series of horizontal channel-shaped tracks, such as the tracks 34 and 36. The stud assembly 10 generally includes a T-shaped stud 38 that is preferably formed of sheet metal or sheet steel, and that coincides with, and retains, opposed surface panels, such as the panels 14 and 19.

The stud 38 includes a pair of elongated shoulder portions 35 and 39, that are interconnected throughout their axial lengths by a stem to form a double strength web 33. The shoulder portions 35 and 39 are generally similar in design and construction, and therefore only the shoulder portion 35 will be described hereinafter in greater detail, with particular reference to FIGS. 2 and 3 of the drawings.

The shoulder portion 35 includes a central stepped section 91, for receiving and for retaining frictionally a front portion 101 of a bracket support 44. The bracket support 44 is generally of the type disclosed and claimed in the U.S. Pat. No. 4,581,859, to Doke et al., and it generally includes the front portion 101, a rear portion 102, a pair of flat mounting flanges 110 and 111, a wall standard 62, and a covering 61.

The stepped section 91 extends on either side into two generally similar flange retaining sections 93 and 93A, which are particularly shaped to rigidify the structure of the shoulder portion 35, as well as to retain securely the mounting flanges 110 and 111 of the bracket support 44. Furthermore, when the surface panels 14 and 16 are secured to the stud assembly 10, two narrow elongated spacings 120 and 122 are defined therebetween, to allow a reasonable deformation in the frame structure 25 of the wall unit 10.

In use, the stud assembly 10 is assembled at the manufacturing location, and then transported as a single unitary package to the construction site. The stud assembly 10 is then mounted securely in an upright position intermediate the upper and the lower track 34 and 36, to form the frame structure 25 of the wall unit 12. The bracket support 44 is securely retained in frictional engagement with the stud 38 by means of the flange retaining sections 93 and 93A, even when the stud assembly 10 is mounted in an upright position. Precise positioning of the bracket support 44 along the length of of the stud 38, can be obtained by tamping the bracket support 44 downwardly or upwardly, to cause it to move adjustably to a predetermined position. Thereafter, one or more wall brackets, such as the wall brackets 49 and 50 are secured to the stud 38 by conventional techniques.

Considering now the stud 38 in greater detail with particular reference to FIGS. 2 and 3 of the drawings, it is preferably formed of two identical cold rolled elongated channels 73 and 75 and are secured symmetrically back-to-back in a mirror image. Each one of the channels 73 and 75 has a unitary one piece construction, and is generally U-shaped in cross-section throughout its entire length.

The channel 73 includes a pair of leg portions 77 and 79, and an interconnecting bight portion 82. Similarly, the channel 75 includes a pair of leg portions 84 and 86 generally identical to the leg portions 77 and 79, and an interconnecting bight portion 88 which is generally identical to the bight portion 82. For brevity and clarity purposes, only the leg portions 77 and 86 will be described hereinafter in greater detail. The letter "A" has been added to the reference characters of various parts of the leg portion 86 which are similar to corresponding parts of the leg portion 77.

The leg portion 77 includes a series of discrete steps 80, 81 and 83, which depend integrally from, at generally right angles to, the bight portion 82, and which terminate in a flange retaining section 93. The discrete steps 80, 81 and 83 of the leg portion 77 coordinate with the corresponding discrete steps 80A, 81A and 83A of the leg portion 86 to form a central stepped section 91 for receiving and retaining frictionally, the front portion 101 of the bracket support 44.

The flange retaining sections 93 and 93A are disposed symmetrically on either side of the central stepped section 91. The flange retaining sections 93 and 93A further coordinate with the stepped section 91 to form a shoulder portion 35, for securing the flanges 110 and 111 of the bracket support 44 to the stud 38, and for rigidifying the structure of the leg portion 77.

In this regard, the flange retaining section 93 includes a relatively short interior edge 102 which generally extends inwardly at a right angle relative to the step 83, for rigidifying the structure of the leg portion 35. The interior edge 102 extends, and is reversely bent, into an L-shaped elbow 105, for defining a narrow elongated passageway 108 with the step 83. The passageway 108 is generally hollow throughout its length, and extends from the upper end 30 to the lower end 32 of the stud 38. Thus configured, the elbow enhances the structural rigidification of the leg portion 77.

The passageway 108 and the oppositely disposed passageway 108A receive and retain, frictionally, the opposed respective edges 118 and 119 of the flanges 110 and 111 of the bracket support 44. The bracket support 44 and the stud 38 are assembled at the manufacturer's location according to the customer's specifications. The front portion 101 of the bracket support 44 is first applied against the shoulder portion 35, at a predetermined distance relative to the upper and lower ends of the studs. The flange retaining portions 93 and 93A are then formed through a cold rolling process, and are caused to tightly retain the flanges 110 and 111 of the support bracket 44 in a secure frictional manner.

Thus, since the bracket support 44 is retained by the stud 38, no further retention devices are required, and the assemblage of the stud assembly 10 is substantially expedited. Additionally, the contractor or assembler is now able to complete the erection of the wall unit 12 with substantial ease and economy.

While the wall assembly disclosed in the U.S. Pat. No. 4,581,859 of Doke et al. described means for securing the bracket support to a wall stud, the stud is less conveniently designed than the stud 38 of the present invention. In fact, unlike the present stud 38, the previously disclosed wall stud relies on a pincer action, and on conventional screws to fix the bracket support to the wall stud. Therefore, by causing the flange retaining sections to secure the bracket support frictionally to the stud 38, the present invention has realized a substantial improvement over the existing wall assemblies.

The practical aspect of the present invention is emphasized by the substantial reduction in the on site assembly time, as well by the simplification of such assembly. Furthermore, the frictional self-engagement of the stud 38 and the bracket support 44, frees both of the installer's hands for the other required construction tasks, such as checking the alignment of the wall unit 12. Moreover, the complete assemblage of the stud assembly 10 by the manufacturer can be automated for mass production, thereby further reducing the overall installation cost of the wall unit in general, and of the stud assembly in particular.

As best illustrated in FIG. 2 of the drawings, the central stepped section 91 is shaped and dimensioned similarly to the corresponding front stepped periphery or surface of the bracket support 44 for retaining it securely and frictionally. Thus, when the stud 38 and the support 44 are assembled, the central stepped section 91 of the stud 38 abuts, and coincides in overlying relationship with the stepped front surface of the bracket support 44.

Thus, when surface panels 14 and 16 are secured to the stud assembly 10, the two narrow elongated spacings 120 and 122 defined therebetween, enable the metallic frame structure 25 to deform freely in response to variances in the ambient temperature, without distorting the alignment of the surface panels 14 and 16. Hence, the spacings 120 and 122 help maintain the aesthetic appearance of the wall unit 10.

Considering now the web 33 in greater detail with particular reference to FIG. 1 of the drawings, it generally includes a series of polygonal and circular apertures, such as the apertures 130 and 135, disposed along substantially the entire length of the web 33. The polygonal aperture 130 acts as an orifice to permit the passage of electrical or other conduits, or reinforcing bars, such as the illustrated bar 139, and associated material for securing the reinforcing bar 139 to the frame structure 25 of the wall unit 12. In the event the reinforcing bar 139 is passed through the polygonal aperture 130, the circular or round aperture 135 is used for the passage of wire to secure the bar 139 tightly to the web 33, inside the aperture 130.

The separate sheet metal portions forming the double strength web 33 are secured together by stitching, as best illustrated in the U.S. Pat. No. 4,581,859 to Doke et al. The stitches are generally indicated at 141, 142, 143, and 144 in FIG. 1. The stitching arrangement is speedily and conveniently accomplished without the application of the severe heat gradients that characterize welding, and that may cause significant metallurgical degradation of the frame structure 25.

While the present invention has been illustrated and discussed with regard to its presently preferred embodiment, its scope is not limited thereto. Rather, it is limited only insofar as defined in the following set of claims and equivalents thereof.

What is claimed is:

1. A stud for use with a bracket support in forming a wall unit, comprising:

(a) a pair of unitary elongated channels arranged back-to-back to form a common flat web, each one of said channels being a mirror image of the other channel;

(b) said web extending integrally with and interconnecting two generally similar elongated shoulder portions;

(c) each one of said shoulder portions defining a stepped section for receiving and retaining the bracket support, each one of said flange retaining sections including a relatively short orthogonal interior edge which is reversely bent into a generally L-shaped elbow that defines a narrow elongated passageway with said stepped section; and (d) said stepped section extending integrally into and interconnecting two generally similar flange retaining sections for rigidifying said shoulder portion and for further securing the bracket support into frictional engagement with the stud.

2. A stud as defined in claim 1 for supporting a plurality of surface panels wherein said shoulder portion defines at least one generally narrow elongated spacing with the surface panels for enabling the stud to deform freely with the variances in ambient temperature.

* * * * *